US009169647B2

(12) United States Patent
Gelbaum

(10) Patent No.: US 9,169,647 B2
(45) Date of Patent: Oct. 27, 2015

(54) SKYLIGHT HAVING MULTIPLE STATIONARY TILTED REFLECTORS AIMED IN DIFFERENT COMPASS DIRECTIONS INCLUDING INVERTED PYRAMIDAL OR WEDGE GEOMETRY

(71) Applicant: Entech Solar, Inc, Grapevine, TX (US)

(72) Inventor: David Gelbaum, Cosa Mesa, TX (US)

(73) Assignee: Entech Solar, Inc., Grapevine, TX (US)

( * ) Notice: Subject to any disclaimer, the term of this patent is extended or adjusted under 35 U.S.C. 154(b) by 0 days.

(21) Appl. No.: 14/038,566

(22) Filed: Sep. 26, 2013

(65) Prior Publication Data

US 2014/0083029 A1 Mar. 27, 2014

Related U.S. Application Data

(60) Provisional application No. 61/705,941, filed on Sep. 26, 2012.

(51) Int. Cl.
*E04B 7/18* (2006.01)
*E04D 13/03* (2006.01)

(52) U.S. Cl.
CPC ..... *E04D 13/033* (2013.01)

(58) Field of Classification Search
CPC ..... E04D 13/033; E04D 2013/34; E04D 2013/0345; F21S 11/007
USPC ..... 52/80.1, 200; 126/570, 621, 623, 684, 126/687, 692, 696
See application file for complete search history.

(56) References Cited

U.S. PATENT DOCUMENTS 4,820,020 A * 4/1989 Terrill ..... 359/592
5,467,564 A * 11/1995 DeKeyser et al. ..... 52/173.3
5,648,873 A * 7/1997 Jaster et al. ..... 359/591

* cited by examiner

*Primary Examiner* — Patrick Maestri
(74) *Attorney, Agent, or Firm* — Duane Morris LLP

(57) ABSTRACT

A skylight system uses multiple stationary tilted reflectors aimed in different compass directions, including inverted pyramidal or wedge geometry to enhance the light output of a skylight using a conventional horizontal penetration into the building. The reflectors are made of very low cost metallized polymer film, and configured to maximize the useful lumen output of the skylight over the whole day and over the whole year. The skylight system furthermore improves the light distribution under the horizontal penetration by directing more light vertically into the working space beneath the roof penetration rather than horizontally onto walls and into the building occupants' eyes, creating glare and discomfort.

9 Claims, 6 Drawing Sheets

SKYLIGHT HAVING MULTIPLE STATIONARY TILTED REFLECTORS AIMED IN DIFFERENT COMPASS DIRECTIONS INCLUDING INVERTED PYRAMIDAL OR WEDGE GEOMETRY

RELATED APPLICATIONS

This application claims priority benefit of U.S. Provisional Application 61/705,941 entitled "Skylight Having Multiple Stationary Tilted Reflectors Aimed in Different Compass Directions Including Inverted Pyramidal or Wedge Geometry" filed Sep. 26, 2012, the entirety of which is incorporated herein by reference.

BACKGROUND

Conventional horizontal skylights suffer from poor sunlight collection when the sun is low in the sky, i.e., when the sun's elevation angle is small. This poor low-sun-angle performance leads to poor lighting in the wintertime in most moderate latitudes, and to poor lighting early and late in the day in all locations. Previous attempts to solve this problem have sometimes used expensive tracking reflectors above the skylight penetration into the building, or sometimes used fixed reflectors or prismatic lenses above the skylight penetration with less than adequate performance.

Embodiments of the skylight described herein use multiple stationary tilted reflectors aimed in different compass directions, including inverted pyramidal or wedge geometry to enhance the light output of a skylight using a conventional horizontal penetration into the building. The reflectors are made of very low cost metallized polymer film, and configured to maximize the useful lumen output of the skylight over the whole day and over the whole year. Thus, the light distribution under the horizontal penetration is improved by directing more light vertically into the working space beneath the roof penetration rather than horizontally onto walls and into the building occupants' eyes, creating glare and discomfort.

FIG. 1 illustrates the summer and winter sun and the angle of incident upon the transparent dome 4 (FIG. 3). The angle of incident of the summer sun with respect to level ground or the horizon is shown as $\theta_s$. $\theta_s$ is shown generally, but may represent of a metric of the summer sun, such as an average daytime angle, an average peak angle, peak angle etc. Similarly, $\theta_w$ is the angle of incident of the winter sun with respect to the horizon. $\theta_w$ may also be representative of some metric of the winter sun. As noted above, in some cases it may be advantageous to capture the winter sun while shading the summer sun.

FIG. 2 is an illustration of the angle of incident during the day. As shown, $\theta_e$ is the angle of the sun in the evening, for example 4 pm, whereas $\theta_m$ is the angle of the sun in the morning at for example 10 am. The values used for $\theta_e$ and $\theta_m$ may as described above be chosen as averages, peaks, or corresponding to or biased to specific times. $\theta_e$ and $\theta_m$ need not be the same. FIG. 2 also shows the angle of the midday sun $\theta_{md}$. In warmer climates the midday sun may unnecessarily heat the interior of the building or provide excessive glare and thus it may be advantageous to limit the light during these periods.

Embodiments of the skylight described herein include multiple stationary tilted reflectors aimed in different compass directions, including inverted pyramidal or wedge geometry, to increase the daily and annual light output of a skylight using a conventional horizontal roof penetration. The multiple stationary reflectors are oriented and tilted to provide not only higher light output over more hours of the day and year, but also more downwardly aimed light into the working space beneath the roof penetration. Thus, both the quantity and quality of the natural lighting inside the building are improved. The greater quantity of daylight saves more energy for conventional electrical lighting, improving the economics of the skylight, and the better quality of the light improves working conditions for the occupants of the building. In addition, reducing summer time or midday sun also has the advantages of reducing cooling cost and excessive glare.

The disclosed subject matter presents a novel skylight for providing natural lighting to the interior of a building. The skylight includes a transparent dome rising above a roof of the building and having a light passage at one end to allow light into the interior of the building from the exterior of the building. A first stationary and tilted reflective surface faces a first compass direction and additional stationary and tilted reflective surfaces each face a respective compass direct, where the first compass direction and the respective compass directions are not the same, but each have of the first and additional surfaces have a common vertical component. The reflective surfaces of the skylight are within the transparent dome.

The disclosed subject matter also presents a novel device for passively providing light from a source external to a building to an interior of a building. The device includes a transparent dome projecting into the exterior of the building with a light passage from the interior to the exterior of the building. In the transparent dome, a plurality of fixed reflective surfaces are positioned, each reflective surface defined by a vector normal to their reflective surface having an azimuth direction, and an angle with respect to the horizon. The vectors associated with the fixed reflective surfaces are different from each other vector.

The disclosed subject matter also includes a novel method for providing natural lighting to the interior of a building. The method includes providing a skylight with a plurality of reflectors aimed in different compass directions and a light passage to the interior of the building. The plurality of reflectors are tilted to direct light below a threshold angle of incident with the horizon into the light passage and to prevent light above a second threshold angle of incident from entering the light passage; and fixed in place prior to the installation of the skylight. The skylight is installed above the light passage and light below the threshold is directed into the light passage and light above the second threshold is prevented from entering the light passage by the plurality of reflectors.

These and many other advantages of the present subject matter will be readily apparent to one skilled in the art to which the invention pertains from a perusal of the claims, the appended drawings, and the following detailed description of preferred embodiments.

DETAILED DESCRIPTION

The following detailed description of preferred embodiments refers to the accompanying drawings, which illustrate specific embodiments of the disclosed subject matter. Other embodiments having different structures and operations do not depart from the scope of the present disclosed subject matter.

Figure 1:
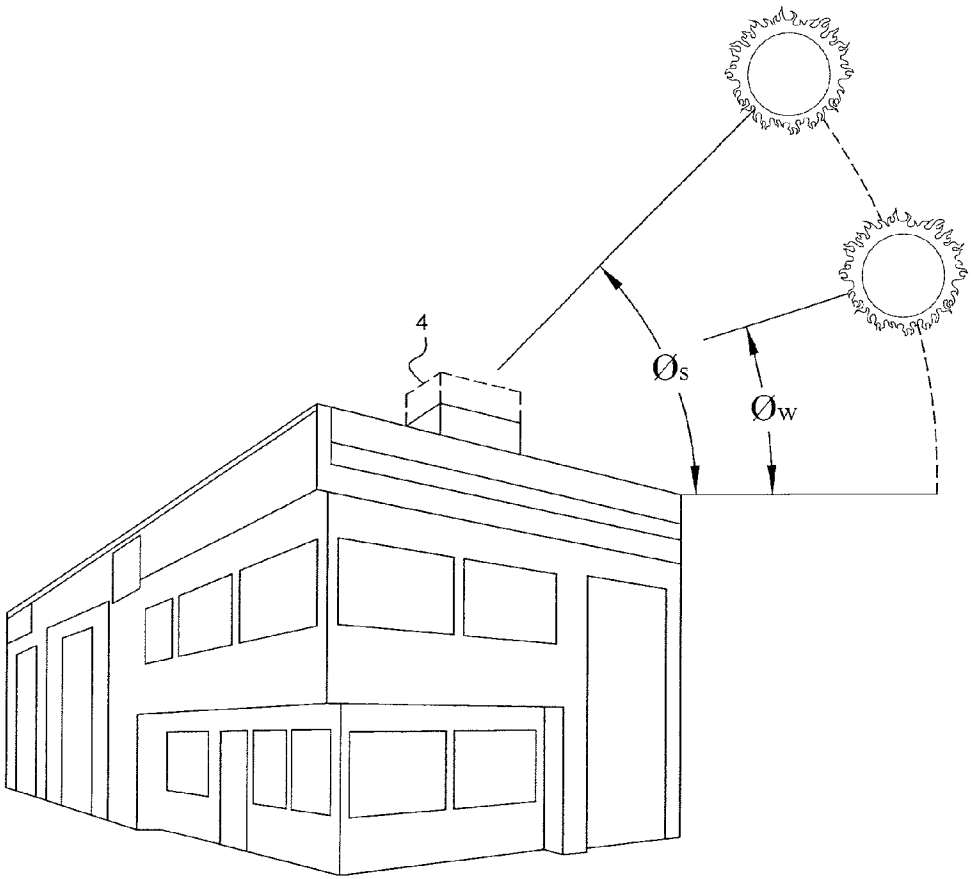
FIG. 1 is an illustration of the angle of incident of the summer and winter sun.
Figure 2:
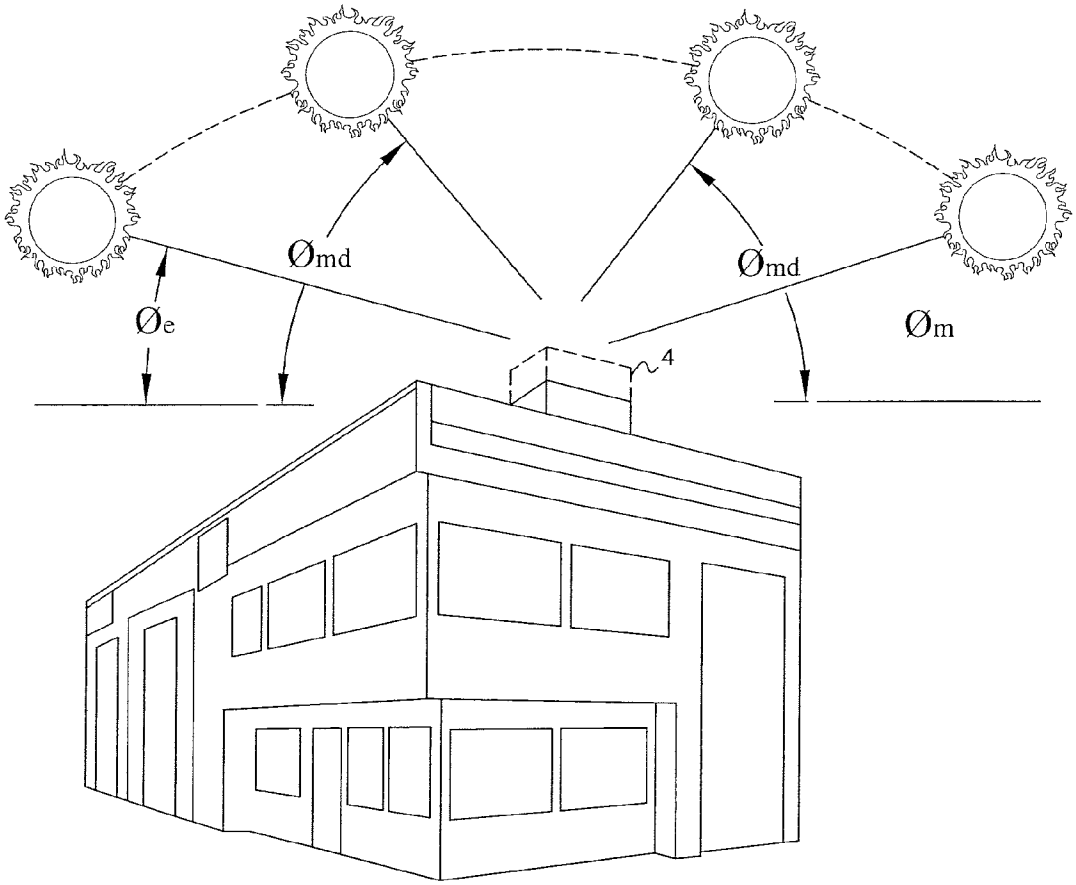
FIG. 2 is an illustration of the angle of incident during the day.
Figure 3:
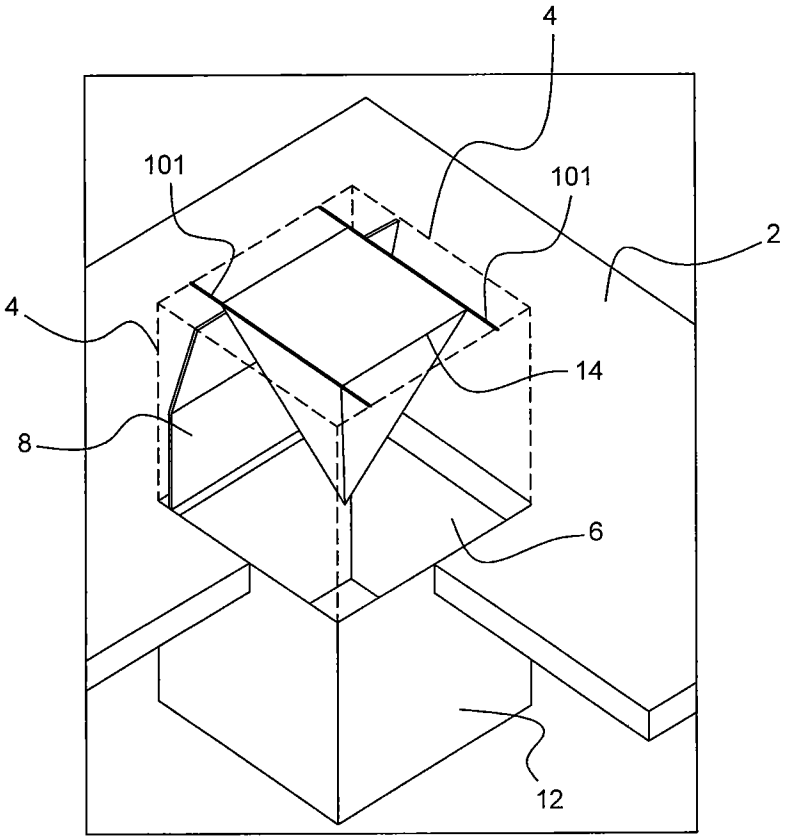
FIG. 3 presents a perspective view of an exemplary skylight, including an inverted pyramidal reflective element, according to an embodiment.

Referring first to FIG. 3, an exemplary skylight is shown that can be used in commercial, industrial, and institutional applications wherein the roof 2 is generally close to horizontal and includes the usual construction of an external weather-tight membrane, iso-foam insulation, a corrugated steel deck, and supporting structure of steel joists and beams. These roof features of the roof are not shown in detail in the roof 2 in FIG. 3 but are described herein simply to provide an exemplary environment in which the skylight of FIG. 3 can be used. The skylight may include a transparent dome 4 which can be a variety of shapes, but is shown for example as a cubical shape in FIG. 3. The transparent dome 4 may be made from acrylic plastic or polycarbonate plastic or tempered glass, or other appropriate material that allow light to pass while protecting the interior environment. Between the transparent dome and the interior building space is a roof penetration 6 or light passage which can be a variety of shapes but is shown for example purposes as a square opening in FIG. 3. Within or under the transparent dome 4, the skylight may include a back reflector 8 for redirecting sunlight entering the clear dome 4 from the sky from the general direction of the Earth's equator shown by the arrow in FIG. 3. For the northern hemisphere, the equator is to the south, and some of the sunlight that enters the clear dome 4 from the south will reflect off the back reflector 8 and enter the roof penetration 6 and be delivered into the building below as useful light, either directly or after reflecting from the interior surfaces of a reflective light pipe 12, which is an optional component of the present disclosed subject matter. More over other ambient environmental light such a street lights, moon light, other outdoor lighting may also be directed into the light passage. As shown in the exemplary embodiment of FIG. 3, the skylight includes an optical device 14, shown as an inverted reflective pyramid 14, however many other shapes are envisioned and disclosed. This optical device 14 can accept sunlight from all compass directions, also known as different azimuth directions, and reflect a portion of that sunlight downward through the roof penetration 6 into the building below. The inverted pyramidal reflector 14, either with or without the back reflector 8, improves the performance of the present subject matter for collecting and delivering low sun elevation angle sunlight into the building as useful light compared to conventional prior art skylights without these multiple stationary tilted reflective surfaces facing different compass directions. As noted previously performance can be further improved with the back reflector 8, which can be segmented to have more than one surface tilted at more than one angle, as shown in FIG. 3. Similarly, the inverted pyramidal reflector 14 can be configured with a variety of triangular side tilt angles for different geographic locations, i.e., different latitude angles and different angle of incidence θ. The top base of the inverted pyramidal reflector 14 can be covered with reflective material to minimize heat buildup in the skylight dome, or an opaque surface to prevent or diminish the light incident upon it from entering the interior of the building through the light passage 6.

For the embodiment shown in FIG. 3, the transparent dome 4 may be made from impact resistant acrylic plastic, to withstand hail and wind and sunlight exposure. The reflective surfaces of the back reflector 8 and the pyramidal reflector 14 and the optional light tube 12 can be made from a metallized polymer film, for example, aluminized polyester film, one example of which is called MYLAR®. Aluminized polyester film is extremely inexpensive and provides excellent visible light reflectance. The aluminized surface on the aluminized polyester film can be overcoated with a thin clear polymer layer such as a clear lacquer to protect the metal from corrosion. The vertical position of the pyramidal reflector 14 can be selected to maximize light collection at the times of day ($\theta_{md}$, $\theta_e$ and $\theta_m$) and seasons of the year ($\theta_w$ and $\theta_s$) when such light is most valuable for the occupants of the building being illuminated by the skylight of FIG. 3. These periods may also be bias towards operating hours as well. Furthermore, the vertical position of the pyramidal reflector 14 can be selected with the bottom of the pyramid extending downward through the roof penetration 6 into the interior light tube 12, or, alternatively, the vertical position of the pyramidal reflector 14 can be selected with the bottom of the pyramid above the roof penetration 6. In some embodiments, the pointed tip of the pyramidal reflector 14 can be truncated to form a flat surface at whatever vertical location was desired. The multiple flat surfaces of the tilted reflectors including the back reflector 8 and the pyramidal reflector 14 can be supported with just edge supports such as fiberglass rods to minimize material content, weight, and cost. Gravity can also be used to help support the reflective surfaces of the pyramidal reflector 14 and the interior light tube 12, in the exemplary skylight geometry shown in FIG. 3, with the metallized polymer film, e.g., aluminized MYLAR, hanging from a top frame in the desired shape.

Figure 4:
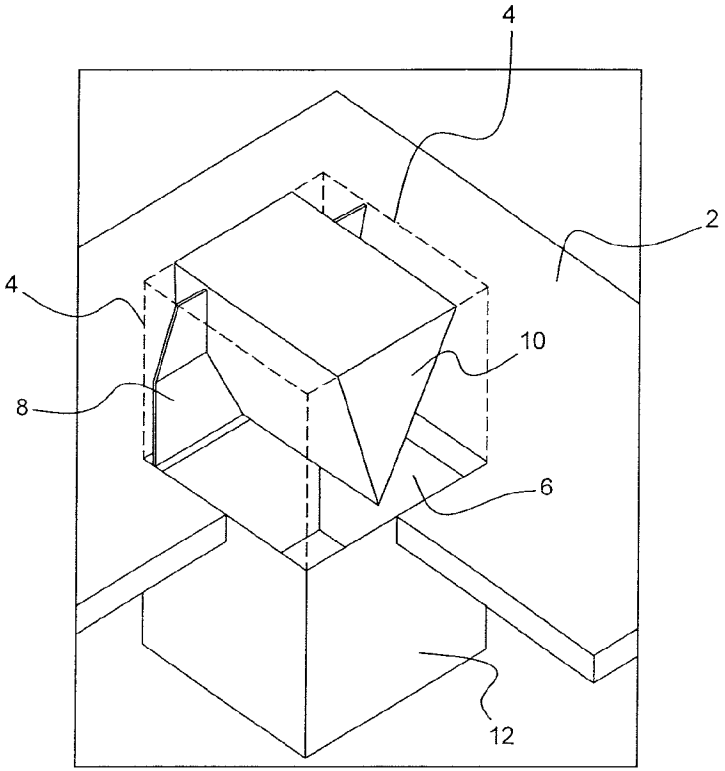
FIG. 4 presents a perspective view of another exemplary skylight, including an inverted wedge reflective element, according to an embodiment.

Referring next to FIG. 4, another exemplary embodiment of a skylight is shown that can be used in applications in which the roof 2 is generally close to horizontal. The skylight of FIG. 4 can include a transparent dome 4 which can be a variety of shapes, but is shown for example as a cubical shape in FIG. 4. The transparent dome 4 can be made from acrylic plastic or polycarbonate plastic or tempered glass. Between the transparent dome and the interior building space will be a roof penetration 6 which can be a variety of shapes but is shown for example purposes as a square opening in FIG. 4. Under the transparent dome 4 the present disclosed subject matter may or may not include a back reflector 8 for redirecting sunlight entering the clear dome 4 from the sky from the general direction of the Earth's equator shown by the arrow in FIG. 4. For the northern hemisphere, the equator is to the south, and some of the sunlight that enters the clear dome 4 from the south will reflect off the back reflector 8 and enter the roof penetration 6 and be delivered into the building below as useful light, either directly or after reflecting from the interior surfaces of a reflective light pipe 12, which is an optional component of the present disclosed subject matter. As shown in FIG. 4, the skylight includes a wedge-shaped reflector 10. This optical device 14 is able to accept sunlight from east and west compass directions, and reflect a portion of that sunlight downward through the roof penetration 6 into the building below. The wedge-shaped reflector 10 improves the performance of the present skylight disclosed subject matter for collecting and delivering low sun elevation angle sunlight into the building as useful light compared to skylights without these multiple stationary tilted reflective surfaces facing different compass directions. The use of the back reflector 8 can further improve performance. In some embodiments, the back reflector 8 can be segmented to have more than one surface tilted at more than one angle, as shown in FIG. 4. Similarly, the wedge-shaped reflector 10 can be configured with a variety of side tilt angles for different geographic locations, i.e., different latitude angles. Furthermore, the front of the wedge-shaped reflector can be tilted to accept and reflect sunlight coming from the compass direction toward the equator (south in the northern hemisphere). The top base of the wedge-shaped reflector 10 can be covered with reflective material to minimize heat buildup in the skylight dome.

For the exemplary embodiment shown in FIG. 4, the transparent dome can be made from impact resistant acrylic plastic, to withstand hail and wind and sunlight exposure. The reflective surfaces of the back reflector 8 and the wedge-shaped reflector 10 and the optional light tube 12 can be made from a metallized polymer film, for example, aluminized polyester film, one example of which is called MYLAR. Aluminized polyester film is extremely inexpensive and provides excellent visible light reflectance. The aluminized surface on the aluminized polyester film can be overcoated with a thin clear polymer layer such as a clear lacquer to protect the metal from corrosion. The vertical position of the wedge-shaped reflector 10 can be selected to maximize light collection at the times of day and seasons of the year when such light is most valuable for the occupants of the building being illuminated by the new skylight. Furthermore, the vertical position of the wedge-shaped reflector 10 can be selected with the bottom of the wedge extending downward through the roof penetration 6 into the interior light tube 12, or, alternatively, the vertical position of the wedge-shaped reflector 10 can be selected with the bottom of the wedge above the roof penetration 6. In some embodiments, the sharp edge of the wedge-shaped reflector 10 can be truncated to form a flat surface at whatever vertical location was desired. The multiple flat surfaces of the tilted reflectors including the back reflector 8 and the wedge-shaped reflector 10 can be supported with just edge supports such as fiberglass rods to minimize material content, weight, and cost. Gravity can also be used to help support the reflective surfaces of the wedge-shaped reflector 10 and the interior light tube 12, in the preferred skylight geometry shown in FIG. 4, with the metallized polymer film, e.g., aluminized MYLAR, hanging from a top frame 101 in the desired shape.

The embodiments shown in FIGS. 3 and 4 are shown as examples only, and many other embodiments and geometries are intended to fall within the scope of this disclosure. Unlike far more expensive skylight units which use motors and mechanisms to orient mirrors under the dome to help collect low sun elevation angle light, the embodiments described herein incorporate cheaper and more trouble-free non-moving mirror surfaces. Unlike other less effective skylight units, which use curved mirrors or prismatic lenses, embodiments described herein use cheaper flat mirror elements which can be readily made from low-cost metallized polymer film such as aluminized MYLAR. Unlike conventional horizontal skylights, embodiments described herein can collect far more low-sun-elevation-angle sunlight, providing much higher illumination early and late in the day, and in the wintertime when the sun is low in the sky all day for non-tropical latitudes. Thus, use of such skylights saves more energy for conventional electrical lighting, and therefore provides better economics, i.e., better return on investment and faster payback time.

The skylight of either embodiment shown in FIG. 3 or FIG. 4 also has the advantage of directing the sunlight more vertically into the building than a conventional skylight. This places more light in the working space beneath the roof penetration, and results in less light entering the building with a more horizontal direction, causing glare and discomfort for the occupants of the building.

Figure 6:
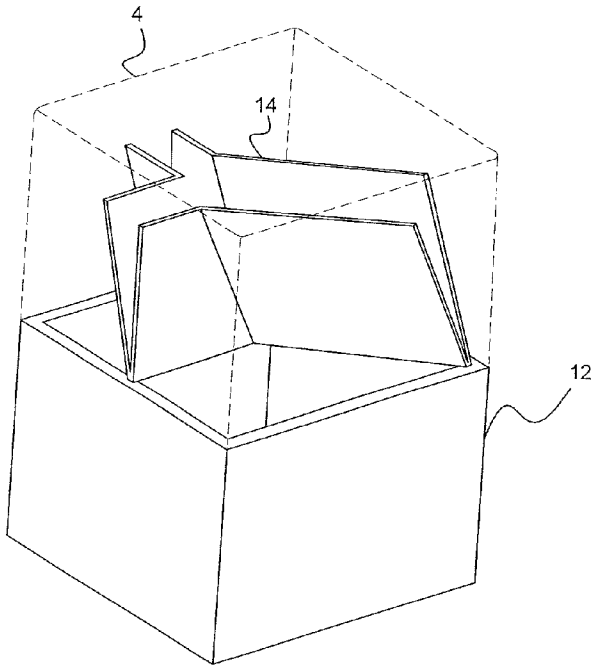
FIG. 6 presents a perspective view of another exemplary skylight, including three inverted wedge reflective elements that form a Y shape.
Figure 5:
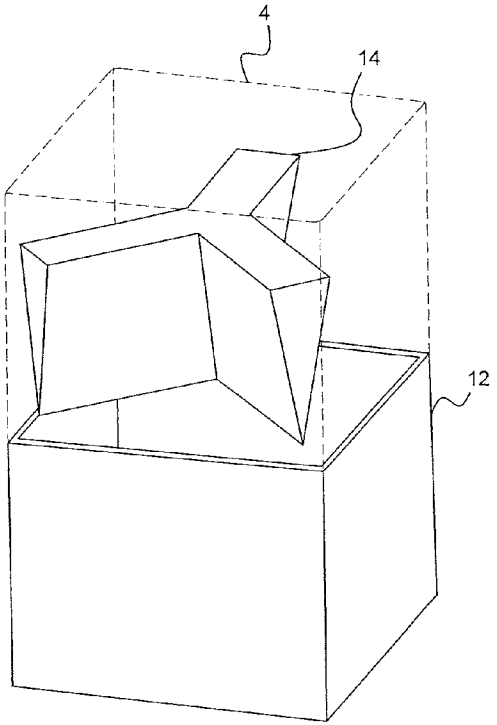
FIG. 5 presents a perspective view of another exemplary skylight, including three inverted wedge reflective elements originating from a common end and rotated 120 degrees.

FIG. 5 illustrates the optical element 14 made up of reflective surfaces that form three wedge elements rotated 120 degrees from each other. The optical element 14 may serve as an Omni directional reflector, or may have the sides of one of the wedges oriented east and west to capture the morning and evening sun, while the other wedges collect the sun light from the equator. FIG. 6 illustrates a modification of FIG. 5, wherein the surfaces that form the wedge of optical element 14 that face east and west respectively are elongated towards in direction of the equator and the remaining wedges are shortened which collect the light from the winter sun.

Figure 8:
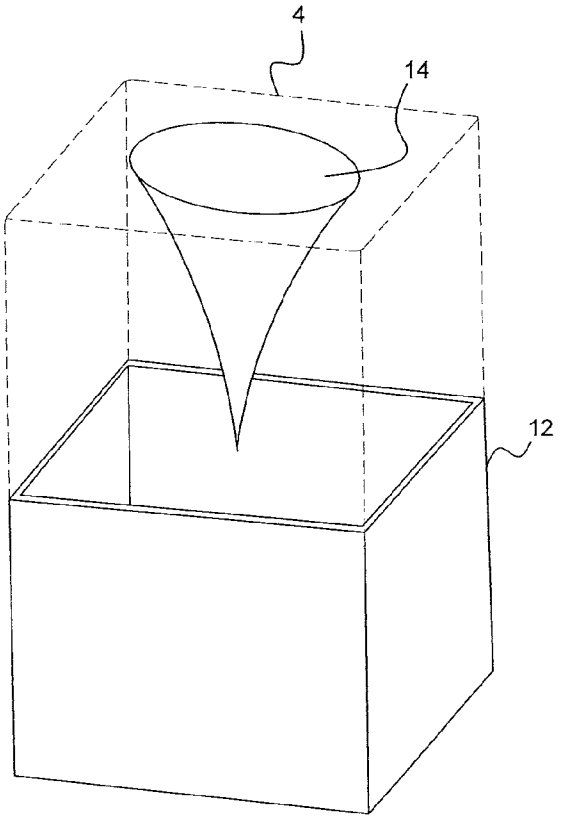
FIG. 8 presents a perspective view of an exemplary skylight, including an inverted hyperboloid shaped reflective element, according to an embodiment.
Figure 7:
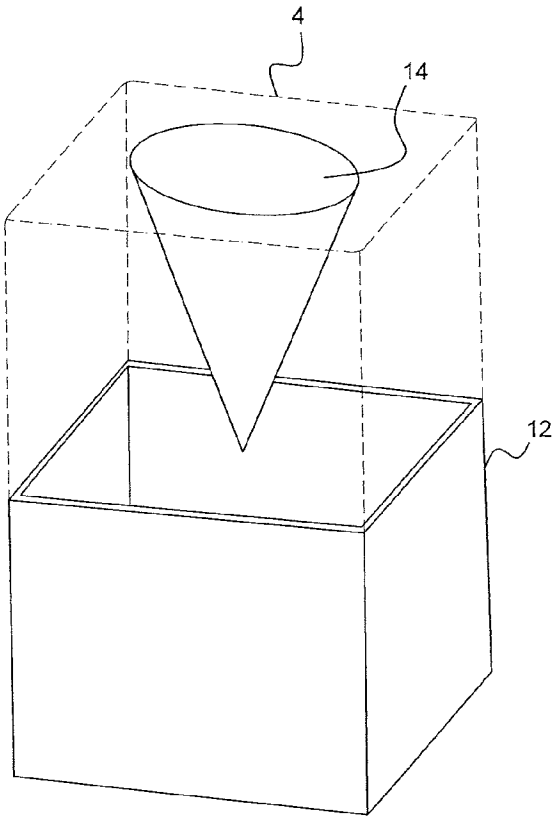
FIG. 7 presents a perspective view of an exemplary skylight, including an inverted cone shaped reflective element, according to an embodiment.

FIGS. 7 and 8 show respectively an inverted cone as the optical element 14 of reflective surfaces and an inverted hyperboloid as the optical element 14. These configurations may again serve as an omni-directional collectors with respect to compass direction but may be coupled with a back reflector 8 facing the equator to increase their effectiveness with respect to a low lying sun.

Each reflective surface described above may be defined, in much the same manner as that of the plane, by the vector which is perpendicular or normal to it. Therefore, each reflective surface with respect to the described skylight has a normal vector that has a azimuth (compass direction) and a vertical component (if it is tilted). The direction in which the surface faces is defined by the azimuth while the tilt is defined by the vertical component.

The selection of the fixed tilt angle for each of the reflective surfaces are determined for reflecting or blocking respective light angles $\theta$, the limits of reflecting and blocking may be established by thresholds associated with a particular latitude, altitude or building orientation. These thresholds may be determined as a function of the winter sun, summer sun, morning sun, evening sun, midday sun, or operating hours of the building or combinations thereof. Averages, peaks and other statistical modes are fully envisioned in establishing the thresholds and thus tilt angles.

While the disclosure subject matter has been described with respect to skylights, the disclosure is not so limited, as the teaching may equally apply to other types of openings to the exterior where light is available to be brought into the interior. Additionally, while the disclosure focuses on directing light from the sun, other sources or ambient light are equally envisioned, for example a large plant, or parking lot may produce a large volume of light pollution which may be directed by the disclosed embodiments into the building by orienting the one or more of the tilted surfaces in the direction of the plant/parking lot.

While preferred embodiments of the present disclosed subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

I claim:

1. A skylight for providing natural lighting to the interior of a building comprising:

a transparent dome projecting above a roof of the building and defining at one end a light passage from the interior to the exterior of the building:

a first stationary and tilted reflective surface defined by a vector normal to the reflective surface having a first compass direction; said vector oblique to the horizon;

one or more additional stationary and tilted reflective surfaces, each of the one or more additional stationary and tilted reflective surfaces defined by a respective vector normal the respective reflective surface having a respective compass direction, said respective vectors oblique to the horizon;

wherein the first and additional reflective surfaces are positioned within said transparent dome;

wherein the first compass direction and the respective compass direction are not the same, and wherein the vector and respective vector have a common vertical direction wherein the first and additional reflective surfaces reflect light having an incident angle with respect to the horizon lower than a predetermined threshold into the light passage;

wherein the first and additional reflective surfaces define a Y shaped wedge.

2. The skylight of claim 1, wherein the threshold is selected as a function of the angle of the winter sun, summer sun, evening sun, morning sun or midday sun.

3. The skylight of claim 1, further comprising a back reflective surface positioned to reflect light that is parallel to the reflective surfaces into the light passage.

4. The skylight of claim 1, wherein the first compass direction is 120 degrees offset from one of the respective compass directions of the one or more additional reflective surfaces.

5. A device for passively providing light from a source external to a building to an interior of a building comprising:

a transparent dome projecting into the exterior of the building and defining at one end a light passage from the interior to the exterior of the building:

a plurality of fixed reflective surfaces, each of said plurality of fixed reflective surfaces defined by a vector normal to their reflective surface having a predetermined azimuth direction, and an angle with respect to the horizon;

wherein each vector associated with the plurality of fixed reflective surfaces is different from each other vector; and wherein the reflective surfaces are positioned within said transparent dome;

wherein the plurality of fixed reflective surfaces are positioned into pairs, the respected reflective surfaces of each pair are attached to one another at one end forming a vertex and separated from one another at another end; the surfaces of each pair share complimentary azimuth angles, such that the respective vectors are parallel in a horizontal plane and wherein the vectors of each pair are offset from the respective vectors in adjacent pairs by 120 degrees in the horizontal plane.

6. The device of claim 5, wherein each of the pairs form a branch having a length, depth and thickness and two of the pairs have a length different from a third pair.

7. The device of claim 6, wherein the vectors of the two pairs have a component in the vertical direction less than the component in the vertical direction of the third pair.

8. The Skylight of claim 1, wherein the stationary and tilted reflective surfaces are made from metallized polymer film and hung from a top frame and draped down by gravity to achieve the respective vectors of the reflective surfaces.

9. The Skylight of claim 8, wherein the top frame is a fiberglass rod.

* * * * *

UNITED STATES PATENT AND TRADEMARK OFFICE

CERTIFICATE OF CORRECTION

PATENT NO. : 9,169,647 B2
APPLICATION NO. : 14/038566
DATED : October 27, 2015
INVENTOR(S) : Mark J. O'Neill et al.

It is certified that error appears in the above-identified patent and that said Letters Patent is hereby corrected as shown below:

On the title page item 72

Please change the address of Mr. Davis Gelbaum

Delete "Cosa Mesa, TX" Insert --Cosa Mesa, CA--

Signed and Sealed this
Fifteenth Day of March, 2016

Michelle K. Lee

Michelle K. Lee
*Director of the United States Patent and Trademark Office*